US008355234B2

(12) United States Patent
Nilman-Johansson et al.

(10) Patent No.: US 8,355,234 B2
(45) Date of Patent: Jan. 15, 2013

(54) CONDITION MONITOR FOR AN ELECTRICAL DISTRIBUTION DEVICE

(75) Inventors: Kristina Nilman-Johansson, Ludvika (SE); Kenneth Wallin, Ludvika (SE); Emile Schreurs, Västerås (SE)

(73) Assignee: ABB Technology Ltd., Zürich (CH)

( * ) Notice: Subject to any disclaimer, the term of this patent is extended or adjusted under 35 U.S.C. 154(b) by 797 days.

(21) Appl. No.: 11/044,718

(22) Filed: Jan. 28, 2005

(65) Prior Publication Data

US 2005/0168891 A1 Aug. 4, 2005

Related U.S. Application Data

(60) Provisional application No. 60/539,989, filed on Jan. 30, 2004.

(51) Int. Cl.
*H01H 9/00* (2006.01)

(52) U.S. Cl. ..... 361/160

(58) Field of Classification Search ..... 361/115, 361/152, 160

See application file for complete search history.

(56) References Cited

U.S. PATENT DOCUMENTS

| | | | | |
|---|---|---|---|---|
| 4,916,628 | A * | 4/1990 | Kugler | 700/286 |
| 5,874,900 | A | 2/1999 | Panto | |
| 6,032,203 | A * | 2/2000 | Heidhues | 710/11 |
| 6,291,911 | B1 * | 9/2001 | Dunk et al. | 307/137 |
| 6,466,023 | B2 | 10/2002 | Dougherty et al. | |
| 6,531,841 | B1 | 3/2003 | Elli et al. | |
| 2003/0123212 | A1 * | 7/2003 | Dunk et al. | 361/160 |
| 2005/0168891 | A1 * | 8/2005 | Nilman-Johansson et al. | 361/23 |

FOREIGN PATENT DOCUMENTS

| | | | |
|---|---|---|---|
| JP | 10094173 | | 4/1998 |
| WO | WO-99/52121 | | 10/1999 |
| WO | WO-01/57985 | A1 | 8/2001 |
| WO | WO-01/93399 | A2 | 12/2001 |
| WO | WO-02/23207 | A1 | 3/2002 |
| WO | WO-02/23571 | A1 | 3/2002 |
| WO | WO-02/23572 | A1 | 3/2002 |
| WO | WO-02/23573 | A1 | 3/2002 |

OTHER PUBLICATIONS

Notification of the Third Office Action from the State Intellectual Property Office of The People's Republic of China, dated Oct. 9, 2009, issued in connection with counterpart Chinese Application No. 200580003750.3.

Notification of the Second Office Action from the Patent Office of the People's Republic of China, dated Jun. 12, 2009, issued in connection with counterpart Chinese Application No. 200580003750.3.

Text of the First Office Action, dated Nov. 28, 2008, issued in connection with counterpart Chinese Application No. 200580003750.3.

International Preliminary Report on Patentability, dated Feb. 6, 2006, issued in connection with International Application No. PCT/SE2005/000109.

Written Opinion of the International Searching Authority, dated May 11, 2005, issued in connection with counterpart International Application No. PCT/SE2005/000109.

* cited by examiner

*Primary Examiner* — Ronald W Leja

(74) *Attorney, Agent, or Firm* — Venable LLP; Eric J. Franklin

(57) ABSTRACT

The invention is a condition monitor for a switchgear device in an electrical power distribution system. The switchgear device is arranged with an electrically powered actuator for operating a moveable part of the switchgear device, for example, operating the opening and/or closing of a circuit breaker. The switchgear device has a control unit with means to receive state information from the actuator, and panel means to present information via an HMI. The HMI may be accessed remotely. In other aspects of the invention a method, a human-machine interface and a computer program for carrying out the method are described.

38 Claims, 8 Drawing Sheets

CONDITION MONITOR FOR AN ELECTRICAL DISTRIBUTION DEVICE

CROSS-REFERENCE TO RELATED APPLICATIONS

This application claims priority to U.S. provisional patent application 60/539,989 filed 30 Jan. 2004.

TECHNICAL FIELD

The present invention is concerned with a condition monitor for equipment in an electrical power distribution system. In particular it is concerned with a condition monitor for electrical distribution devices including an electrical actuator, a device such as a circuit breaker, and comprises an improved human-machine interface (HMI) for condition monitoring and control purposes.

BACKGROUND ART

Electrical power distribution systems for industrial and residential power users a range of equipment that incorporate one or more moving parts, the majority of which equipment is installed outdoors. Such equipment include for example circuit breakers, earthing switches, overload protectors. A circuit breakers is an example of a distribution device with one or more moving parts. Circuit breakers of different types are used to control and adjust the distribution power, switching power feeds on and off and switching from or to different lines or feeders as required. A circuit breaker must be able to break and make normal current loads and above all, be able to interrupt short-circuits due to faults in the system. Modern circuit breakers have interrupting times of around 20 milliseconds and may break a circuit automatically in response to a signal from a fault sensing relay in the power distribution system. By breaking or making a circuit on command from a remote control location, automatically operated circuit breakers provide a significant improvement over manually operated circuit breakers.

Circuit breakers are the most important active components in an electrical power distribution system. Maintenance has to be carried out on circuit breakers to ensure that they operate as designed when required. Moving parts of equipment installed outdoors are subject to many factors that can cause wear, damage or failure, factors including weather conditions, corrosion, lightning strike, animal intrusions etc. However, the costs to the utility owner of preventive maintenance and of scheduled maintenance are high. On the other hand, when a circuit breaker fails the costs or penalties arising from an otherwise avoidable temporary blackout, brownout or other power interruption may be extremely high when a large number of industrial and/or residential consumers are involved.

However, it is not only a question of economic costs to the utility. Making unnecessary repairs may increase the risk of fault at the distribution installation.

U.S. Pat. No. 6,466,023 entitled: Method of determining contact wear in a trip unit, describes a method of determining contact wear in a trip unit of a circuit breaker. The trip unit includes a processor and memory and an algorithm stored in a memory of the trip unit calculates cumulative energy dissipated in the breaker contacts using the current signal detected at the time of separation. Measurement of cumulative energy dissipated in the breaker contacts is said to be proportional to contact wear. Maintenance setpoints are then determined based on industry standard tests and thresholds are provided within the algorithm for notifying local or remote personnel of a necessary maintenance procedure. According to the disclosure, a condition of a trip unit of a circuit breaker requiring maintenance attention may be signaled. However, the estimated condition of the contact points of a circuit breaker is only an estimate and is also only one of many parameters relevant to a condition of a circuit breaker.

WO0193399 A entitled: Browser-enabled remote user interface and automated expansion analyzer for telecommunications power systems; describes an interface for a control unit, and a control unit, for a telecommunications power system. The control unit may be operated by engineers from a remote location to control and/or switch power supplies using such control units, via a browser-enabled interface. Each control unit has bus connections to rectifier units in a telecommunications power supply system may supply state information. However, the control unit described is dedicated to the requirements of a telecommunications power supply system, typically including battery-based back-up power supplies, wherein the equipment is usually arranged indoors, and where the technical problem is one of switching from one power supply to another.

The technical requirement for maintenance of electrical distribution devices with moving parts, such as circuit breakers, in a power distribution system due to such events as lightning strikes or mechanical failure of equipment installed out of doors, and/or taken together with the amount of use, number of operation events etc. The device performs is not addressed in the prior art. Neither is the problem of maintaining such devices as circuit breakers in a timely fashion described.

SUMMARY OF THE INVENTION

The aim of the present invention is to remedy one or more of the above mentioned problems.

In a first aspect of the invention a condition monitor for an electrically operated switchgear device for electrical distribution such as a circuit breaker is disclosed.

In a second aspect of the invention a method for monitoring a condition of an electrically operated switchgear device for electrical distribution such as a circuit breaker is disclosed.

In another aspect of the invention a human-machine interface for monitoring, control and configuration of an electrically operated switchgear device such as a circuit breaker is disclosed.

A computer program, and a computer program recorded on a computer-readable medium is disclosed in another aspect of the invention.

The principle advantage of the present invention is the timely identification and signaling of a fault under operations or a possible fault condition of an electrically operated distribution devices and switchgear with moving parts, such as a circuit breaker.

The utility or power grid owner wants to increase the availability and reduce the service of equipment. For example to avoid a failure and a loss of transmitted energy, time based maintenance may be carried out on a circuit breaker. However time based maintenance might result in unnecessary repair of the circuit breaker. Unnecessary repair causes a higher risk of fault at installation and service. It may also increase the service costs, as for example the time to find the fault and repair it, which will affect the total cost of the outage. A unit for a circuit breaker or other device with moving parts which can indicate and show the different incurrent faults will provide timely information about need for maintenance actions and reduce power failures and reduce the cost of power outage.

The electrical drive of a distribution device with a moving part, such as a circuit breaker, gives previously undreamed of possibilities to carry out condition monitoring and so supervise and analyse the parameters monitored. The analysis can be done in the electrical drive or sent to an external unit, for example a PC. The drive or the unit analyses, stores and gives an alarm concerning faults at a circuit breaker with an electrical drive. The alarms or data are distributed via manual reading or communicated via different communications media for remote reading and/or action. Data, alarms and recommendation are introduced to the operating customer via a user interface.

The device supervision can be executed manually and/or on-line. The electrical drive includes alarm outputs which can indicate the severity of the alarm. When manually or locally reading the data, the output contacts of the electrical drive connects to the common supervision equipment in the station. When none of the outputs from the drive indicate an alarm, the customer may connect to the drive manually and read the actual information.

Condition monitoring gives the opportunity to have detailed technical information about the circuit breaker and the drive which simplifies identifying the technical requirement for maintenance as well as planning of the maintenance and verifying type of fault. The invention may be installed in existing installations as well as new installations.

BRIEF DESCRIPTION OF THE DRAWINGS

A more complete understanding of the method and system of the present invention may be had by reference to the following detailed description when taken in conjunction with the accompanying drawings wherein.

DESCRIPTION OF THE PREFERRED EMBODIMENTS

The condition monitor for an electrically actuated device in an electrical distribution system according to an embodiment of the present invention concerns devices with one or more moving parts that are operated by electrically powered drive means or electrically powered actuator means. Such distribution switchgear and devices with a moving part that is operated by an electrically powered actuator may include for example: a circuit breaker, a disconnector, a switch disconnector, an earthing switch; a switchgear insulator with integrated electric operating device; protection device, overload protection device.

A condition monitor for an electrically actuated circuit breaker is described here in detail as an exemplary practice of an embodiment of the present invention.

The condition monitor for a circuit breaker according to an embodiment of the present invention concerns circuit breakers that are operated by electrical drive means or actuator means. The electrical drive means may be monitored to provide data about the operations of the circuit breaker, and indicate not only operational information, but also information about conditions of the circuit breaker that require maintenance or repair.

Figure 1:
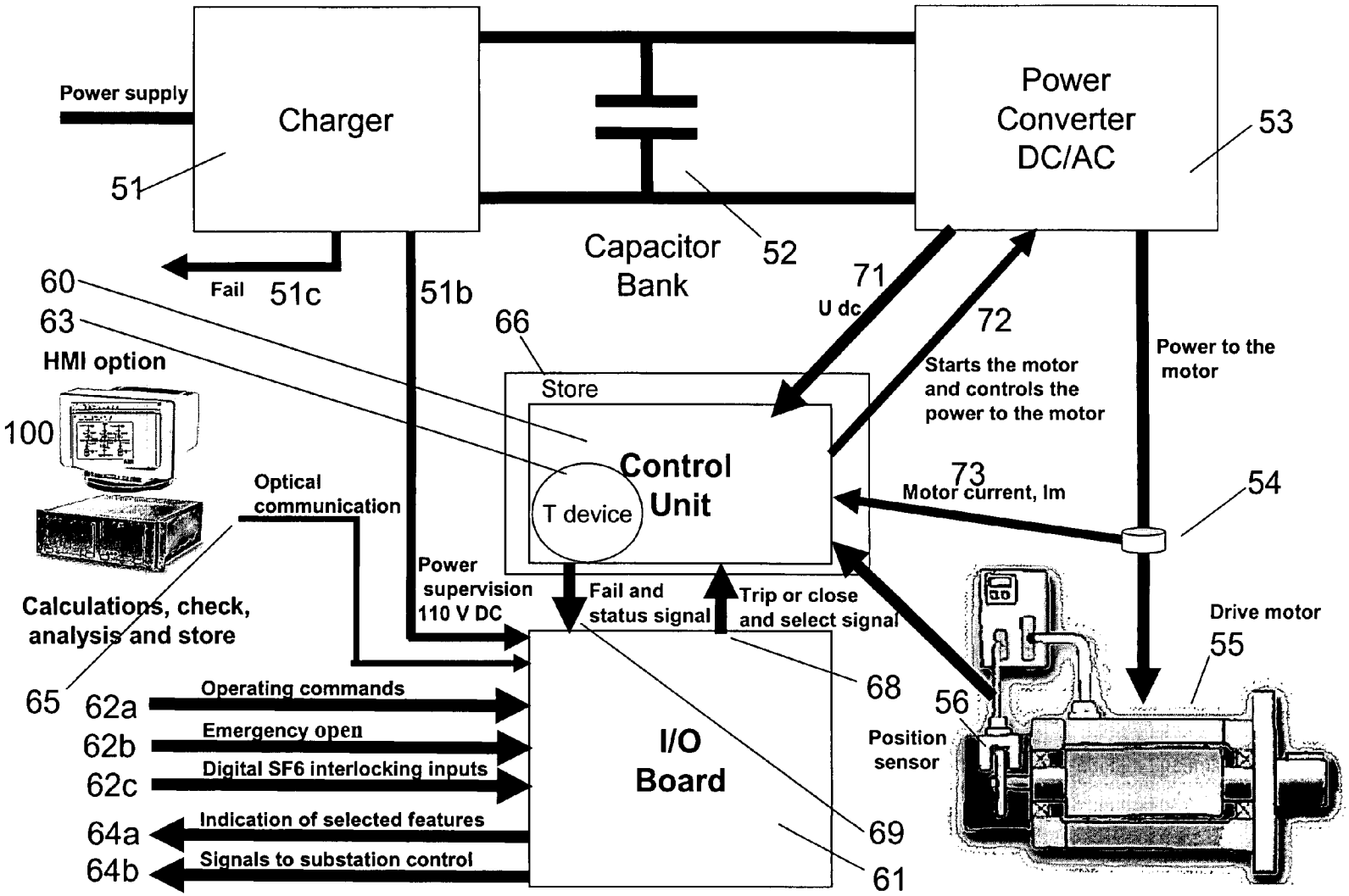
FIG. 1 shows a schematic block diagram of a circuit breaker with a condition monitor function according to an embodiment of the invention.

FIG. 1 shows a condition monitor for a circuit breaker according to an embodiment of the present invention. The figure shows an electric actuator, a drive motor 55 and a power supply via a charger 51, capacitor bank 52, and an AC/DC power converter 53. The power supply to the motor drive 55 is monitored by a sensor 54. The figure shows a control unit 60 for a circuit breaker (not shown) which has memory storage means 66. The control unit 60 is shown arranged for inputs from a position sensor 56 of the drive motor 55, a signal for motor current 73, and a signal for DC voltage 71 from the power converter 53, and for a trip or close signal from an I/O board 61. The control unit 60 is arranged with a trip device 63 which handles the trip or close signal 68 and initiates the tripping sequence from the control unit side. The control unit 60 is shown arranged for outputs such as a power signal 72 to the power converter 53, and Fail and status signal 69 to the I/O board 61. The I/O board 61 is shown arranged, in addition to an input and an output to the control unit, other inputs of Operating commands 62*a*, Emergency open 62*b* and digital $SF_6$ interlocking inputs 62*c*. The I/O board may also send outputs of Indication of selected features 64*a* and Signals to substation control 64*b*. The I/O board may also have an optical communication 65 input/output and 110V DC power supervision input 51*b*. The HMI 100 function is indicated as a display on the left of the diagram.

Figure 2:
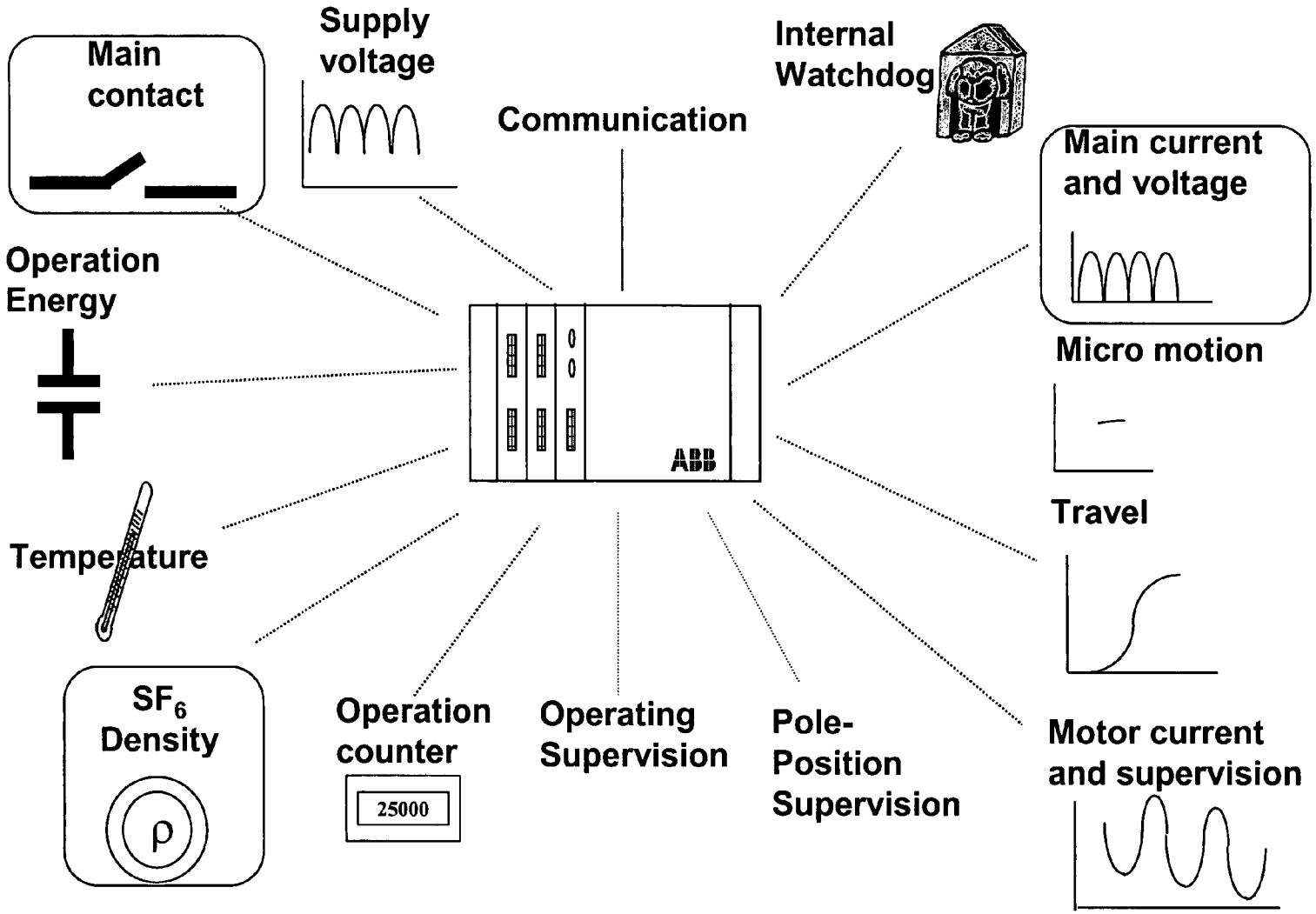
FIG. 2 shows a schematic block diagram of the functions monitored by the condition monitor according to an embodiment of the invention.

FIG. 2 shows functions that may be monitored by a condition monitor according to the present invention. It has to be understood that measurements dependent on monitoring the electrically actuated drive (DM) of the device as well as measurements of other parameters provide new information according to the invention about the operation of the device such as a circuit breaker. The drive motor operating the opening and/or closing of such a circuit breaker is preferably and not exclusively a DC motor or a variable speed control DC motor. The position sensor preferably and not exclusively senses a rotary position of a member such as the main drive shaft of the motor.

The functions monitored on the electrically actuated device or breaker operation may include Motor current, actuator travel or drive shaft travel, micro motion of the drive shaft; as well other circuit breaker parameters or functions such as main (supply) current and voltage, main contact, operation energy, temperatures, density of the SF6 or other insulating atmosphere, count number of operations, monitor operations, monitor pole positions, an internal watchdog function, and a communications function.

Figure 3:
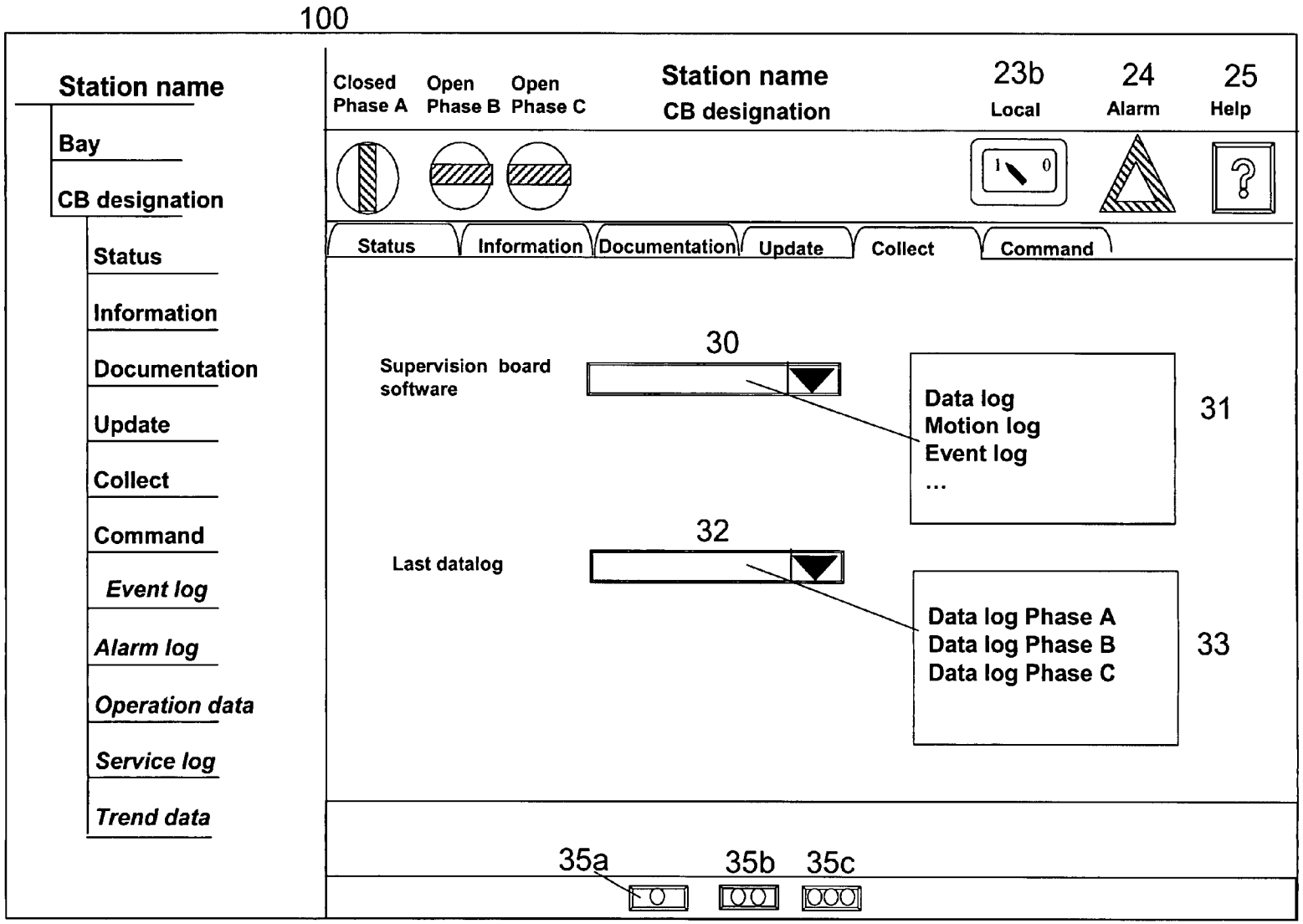
FIG. 3 shows a schematic display for configuring data collection via a human-machine interface of a condition monitor for a circuit breaker according to one embodiment of the invention.

FIG. 3 shows a Collect display of the HMI 100 for the circuit breaker. The display indicates that it is in Local mode at 23*a*. At the top of the display the status of the phases A, B, C are always shown graphically. The Alarm indicator button 24 is always visible, and the Help button 25 always available. The Collect display is for specifying data collection and it includes a configuration window for Supervision board software 30. The Supervision board is the component that provides the condition monitor functions. The configuration window for board software 30 allows a user to specify from a list 31 data collection via some or all of, for example, a Data log, a Motion log, an Event log. A second configuration window from last datalog 32, gives a user access to data logs from a log list 33 such as, for example Data log phase A, Data log phase B, Data log phase C. At the bottom of the display are three user indicators which, when lit, indicate which type of user is logged in. A user with read privileges only is shown by 35*a* lit, and two other levels 35*b*, 35*c* with further privileges are each arranged for users (such as technicians, engineers or manufacturers service engineers) with different passwords.

The data collection information view includes functions so that a user can carry out the following procedures:

Collect the Data logs for phase R-T, from the Supervision board and store the values in the DB, may be only allowed for Manufacturers service engineer (MSE);

Collect the backup Data log from Control board via the supervision board for phase R, may be only allowed for MSE;

Collect the backup Data log from Control board via the supervision board for phase S, not for 3-pole operated CB, may be only allowed for MSE;

Collect the backup Data log from Control board via the supervision board for phase T, not for 3-pole operated CB, may be only allowed for MSE;

Collect the Motion log from the Supervision board, any user;

Collect the Event log from the Supervision board, any user.

The logs shown in the example of FIG. 3 usually includes information such as:

Common: If there is a 1-pole operated CB, performances of all the three phases are logged in the Motion and event log. There is also a choice to look at each phase one at the time.

Data log: The data log for each pole is stored in a non-volatile memory and is reachable via the supervision board. The last five data logs are stored in the RAM memory on each control board. These data logs can be retrieved one by one, via the Supervision board and are called backup data logs. First the backup logs are fetched, but after a voltage interruption, the supervision data log is retrieved. If the backup data log contains no data the HMI may call a routine or offer an option to retrieve the supervision data log. The data log may include data such as the following:

Speed (close/open)
Operation time (close/open)
Peak current
Capacitor voltage at the start of the operation
Capacitor voltage at the end of the operation
Board temperature Data recording different relation between rotor position and contact position may also be included in a data log.

The default micro motion log entry normally contains the following parameters:

Micro motion counter
Date and time
Type of operation
Which pole
Number of tests which had passed successfully
Detected motion
Highest detected difference between the d-current and its set point,
Highest detected difference between the q-current and its set point,
Highest detected difference between the q-current control output and the q-current set point,
Board temperature.

The motion log entry for corrective position control entry normally contains the following parameters:

Operation counter
Date and time
Type of operation
Which pole
Spare (To be defined)
Board temperature The motion log includes entries for any correcting operation.

Event log: Event log includes detection of failure, signalling of warning, reconfiguration of firmware, pending shutdown of the system, restart of system etc. For each event an entry is made into the event log and normally contains the following data:

Date and time
Which pole
Event number, uniquely identifying the type of event.

By means of the data collected, such as that exemplified with respect to FIG. 3, the condition of a device such as a circuit breaker may be monitored in detail, locally or remotely.

Figure 4:
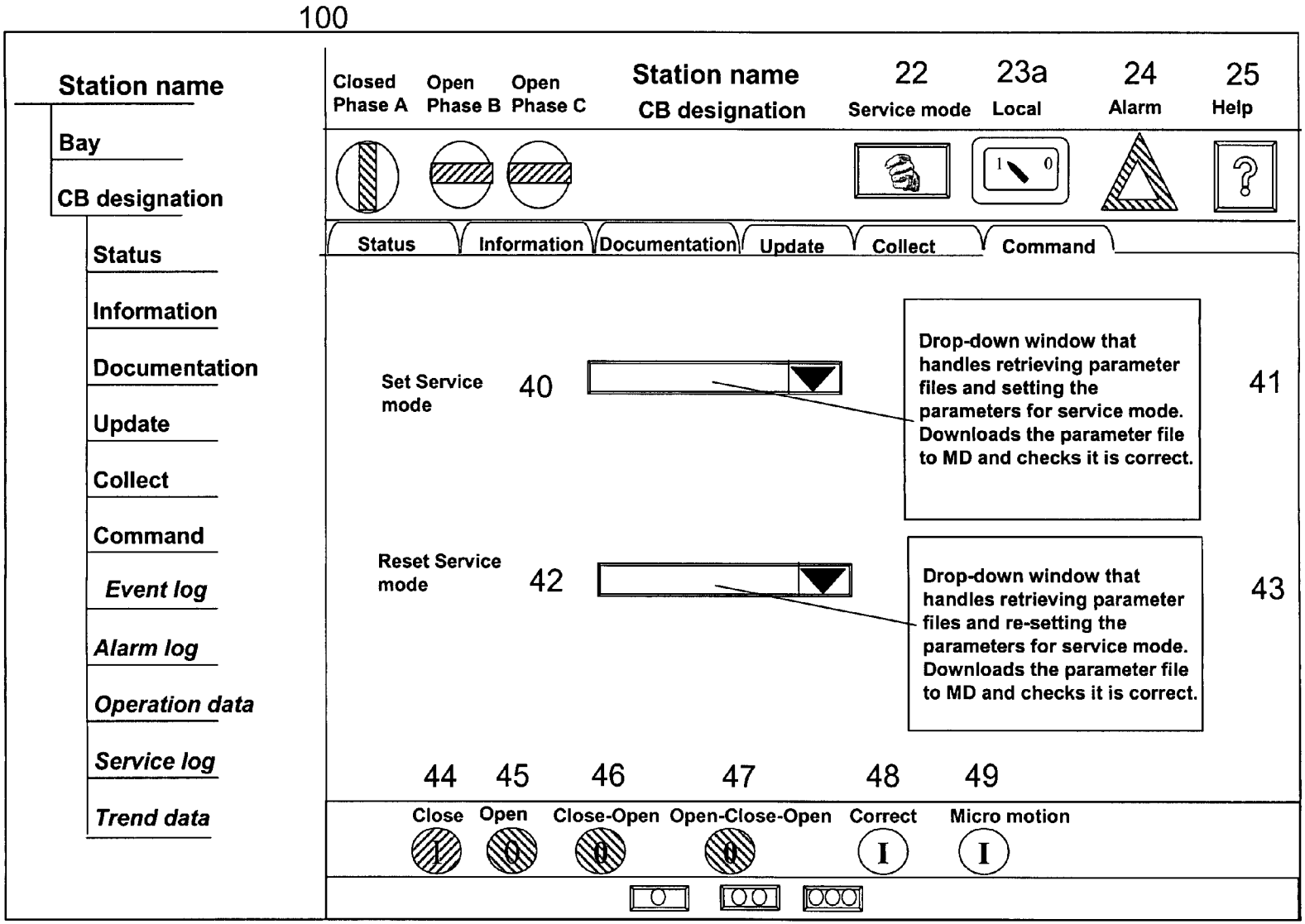
FIG. 4 shows a schematic display for specifying and/or generating commands to equipment in a distribution system via a human-machine interface of a condition monitor.

FIG. 4 shows another display of the HMI 100 for the circuit breaker, the Command display. At the top of the display as well as the status of phases A, B, C, the figure shows that the HMI is set to Service mode 22, and to Local mode 23*a*, the Alarm indicator 24 and Help indicator 25 are visible as standard. The Command tab shows a configuration window for Setting Service mode 40, which window allows a user to retrieve parameter files 41 and set the parameters for service mode; and perform a download of the parameter file to the motor drive and perform a validation check on it. The Command display also shows a second configuration window for Re-setting Service mode 42, which window allows a user to retrieve parameter files 43 and re-set the parameters for service mode; and perform a download of the parameter file to the motor drive (MD) and perform a validation check on it.

At the bottom of the display are shown condition indicators for different phases: I 44, O 45, O 46, O 47, I 48 and I 49.

Figure 5:
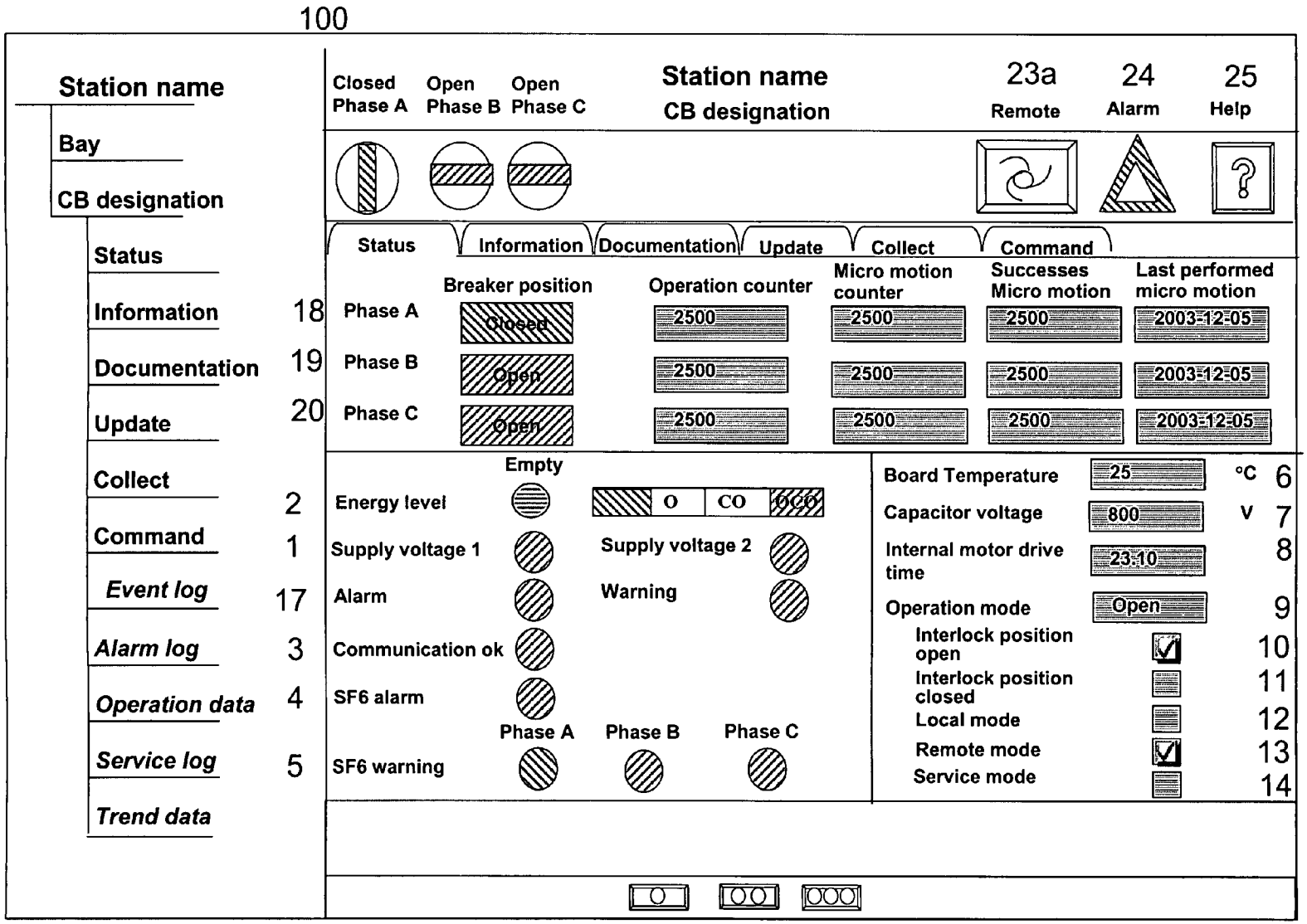
FIG. 5 shows a schematic status display provided by a human-machine interface of a condition monitor.

FIG. 5 shows an exemplary status display of the HMI 100 of the condition monitor for the circuit breaker. The Status display, leftmost tab in diagram, may always be on top when the HMI is first opened or accessed. The figure shows on the left side the Station name 20, the identity of the switchyard Bay, and a CB (Contact Breaker) designation 21. Different operation data logging functions of the condition monitor are listed on the left side comprising; Information, Status (always on top), Documentation, Set data, Update data, Manual operation, Operation data, Event log, Alarm log, Operation data, Service log and Trend data.

Status display. At the top of the display status for three phases A, B, C are shown 18, 19, 20. Phase A is shown with cross hatching from top left to bottom right in this diagram and would in a real operation be displayed in a particular colour, red, in a real display to indicate that the phase is closed. Phases B and C are shown with cross hatching from top right to bottom left in this diagram and would be displayed in another given colour, preferably green, in a real display to indicate that the phase is open. The status display also shows a Remote indicator 23*b*, an Alarm indicator 24 which would normally be coloured appropriately, such as red; and a Help indicator 25 which provides access to Help information.

More detailed information for each of three phases is displayed under the following display selection tabs Status, Information, Documentation, Update, Collect, Command. Details on the Status display are displayed for each phase under the headings of Breaker position, Operation counter, Micro motion Counter, Success Micro motion, and last performed Micro motion.

Lower left on the status display an indicator for Energy level 2 is shown, and indicators 1 for supply voltages 1 & 2. An alarm indicator 17 and warning indicator are shown, and an indicator for communication ok 2. An indicator for a SF6 Alarm may also be included where the circuit breaker is of the type that used a $SF_6$ or other insulating gas atmosphere. Each of the above indicators are cross hatched to indicate green or ok status. An indicator for a SF6 warning 5 is shown as red or not ok for Phase A, and green or ok for Phases B and C.

Status of certain parameters of the condition monitor and circuit breaker itself are shown lower right. A board temperature 6 indicates the temperature of electronic components such as for the condition monitor, implemented for example as a supervision board mounted in the control unit 60. Also displayed is Capacitor voltage 7, internal motor drive time 8, and Operation mode 9. Further indicators show a tick mark when activated, such as Interlock position open 10 and remote mode 13. The other selectable indicators shown not-selected are interlock position closed, local mode 12 and service mode 14.

Thus the status 1 for Supply voltage 1 and 2 is monitored and shown as OK or not OK, as is the status for operation energy 2 and the value displayed. The communication function status is monitored 3 and an Alarm is displayed if not ok. The SF6 alarm is monitored and the value shown with R, S, T warning for 1-pole operated CB and only R for 3-pole operated CB. The status for board temperature 6 is monitored and the value shown; as for operation capacitor voltage 7 and the internal motor drive (MD) clock and the value displayed.

The status for the operation mode 9 is monitored and the value shown. Status for Interlock positions 10, 11 is shown. Operational mode is shown indicated in the HMI as either Local 12, Remote 13 or Service mode 14. Local mode is the mode in which any of the displays of the HMI 100 interface are operated by means of a local panel mounted in a control cabinet and connected to a circuit breaker (or other switchgear device).

Remote mode is the corresponding mode in which all operations that could be carried out via the panel and interface may be carried out remotely using a thin client 90 such as a web browser software to provide a graphical user interface on a remote workstation or portable computer, notebook or other computing device. For example a technician may use a PDA (Personal Digital Assistant) or even a mobile phone enabled with applications to handle HTML, or similar or equivalent thin clients. Communication may be established by wire or wirelessly. The circuit breaker control unit may be connected to a node of a wireless LAN, and/or may be another kind of wireless node, running any radio protocol suitable for an industrial milieu, such as any standard issued by the Bluetooth Special Interest Group (SIG), any variation of IEEE-802.11, WiFi, Ultra Wide Band (UWB), ZigBee or IEEE-802.15.4, IEEE-802.13 or equivalent, or similar. A radio technology working in the ISM band with significant interference suppression means such as by spread spectrum technology may be preferred. For example a broad spectrum wireless protocol in which each or any data packet may be re-sent at other frequencies of a broad spectrum 7 times per millisecond, for example, may be used, such as in a protocol from ABB called Wireless interface for sensors and actuators (Wisa). Wireless communication may also be carried out using Infra Red (IR) means and protocols such as IrDA, IrCOMM or similar. Service mode of the HMI 100 includes additional functions that are not normally enabled present in Local or Remote mode, and may for example be password protected.

Breaker position is monitored 18, 19, 20 and the three values shown for a 1-pole operated CB. When a 3-pole CB is operated operated only one counter is displayed. The status for operation counter is supervised and the value shown, as is the Micro motion counter value, counter of number of Micro motion successful manoeuvres and date of the last successfully performed micro motion, displayed as shown for a 1-pole operated CB, but when a 3-pole CB is operated only one counter is displayed. Alarm and warning level 17 are supervised and the value displayed for the common alarm for the whole CB. Preferably the Alarm is shown red and the warning as yellow.

Figure 6:
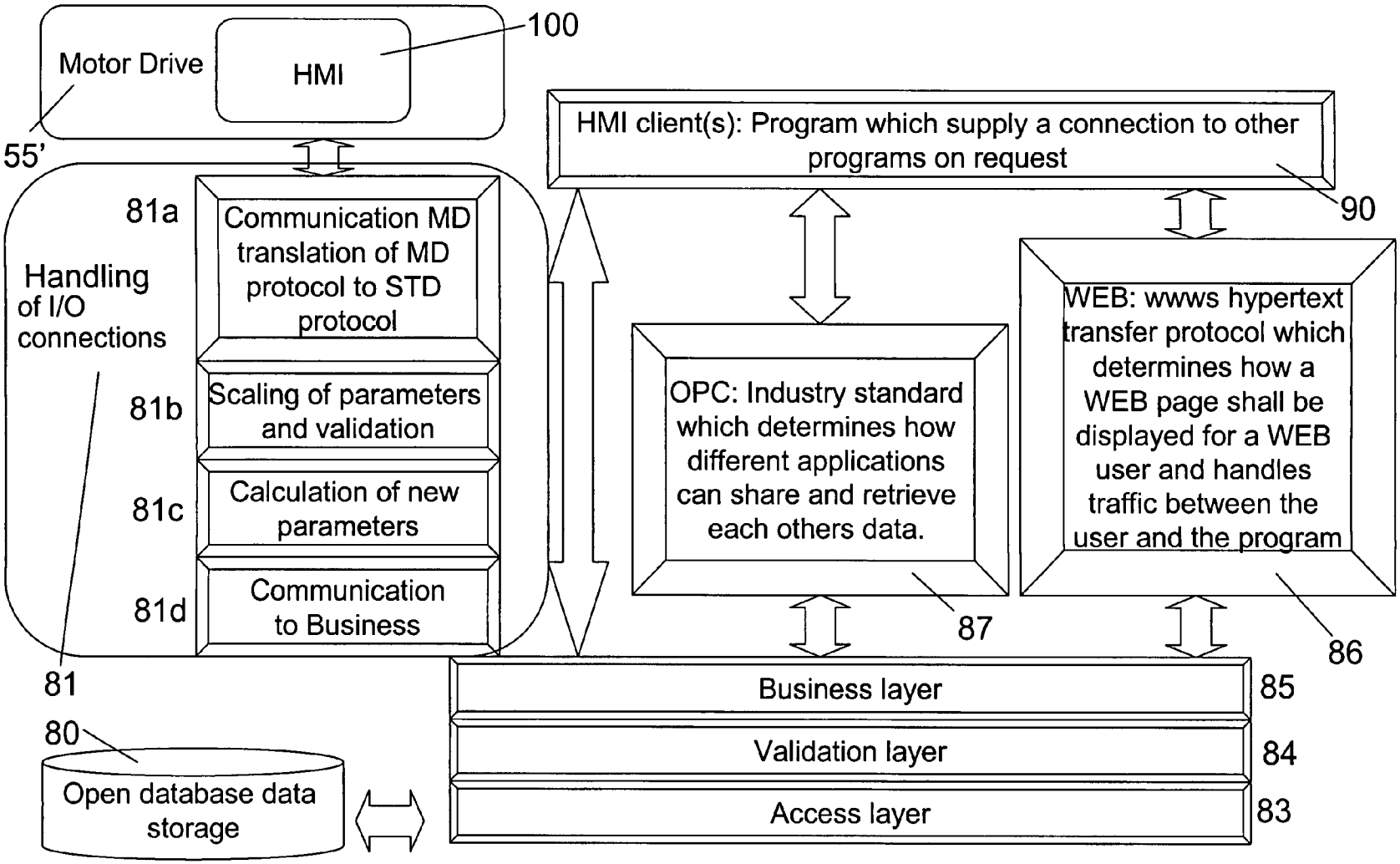
FIG. 6 shows a block diagram of a system architecture for condition monitoring for a device according to an embodiment of the invention.

FIG. 6 shows a diagram for an architecture of the HMI of the present invention. The diagram shows the HMI 100 of the Motor Drive 55, and handling of the I/O connections 81 comprising as examples Communications from the Motor Drive (MD) 81*a* and conversions from MD protocol to a standard (STD) protocol; scaling and validation 81*b* of parameters; calculation of new parameters 81*c* and communication to the business 81*d* meaning input/output to a data network or LAN for general control purposes. The I/O connections 81 are handled to and from a Business layer 85, a Validation layer 84 and an Access layer 83. The access layer is further connected to an Open database data storage 80 function. A client version of the HMI 90 is shown, including remote data access 87 and procedure call handling facilitated via an open standard, and preferably an industrial standard such as OPC (Object (linking and embedding) for Process Control). The client HMI version 90 of the HMI 100 is also shown to be implemented as a thin client using for example HTML or other WWW based or HTML derivative protocol 86 for handling graphical user display and activation functions of the HMI client. For example an XTML or WDML derivative or an application that provides similar functionality such as an I-Mode or WAP standard application. Activation functions refers to functions in the web page or web client display carried out by executable applications or applets which may be implemented as Java™ or similar. By means of such a thin client version 90 of the HMI with an architecture such as that shown in FIG. 6, a user or a technician may examine status or data, configure a parameter, change set points and/or issue commands remotely in Remote mode or even Remote and Service mode to a circuit breaker according to the present invention.

Figure 7:
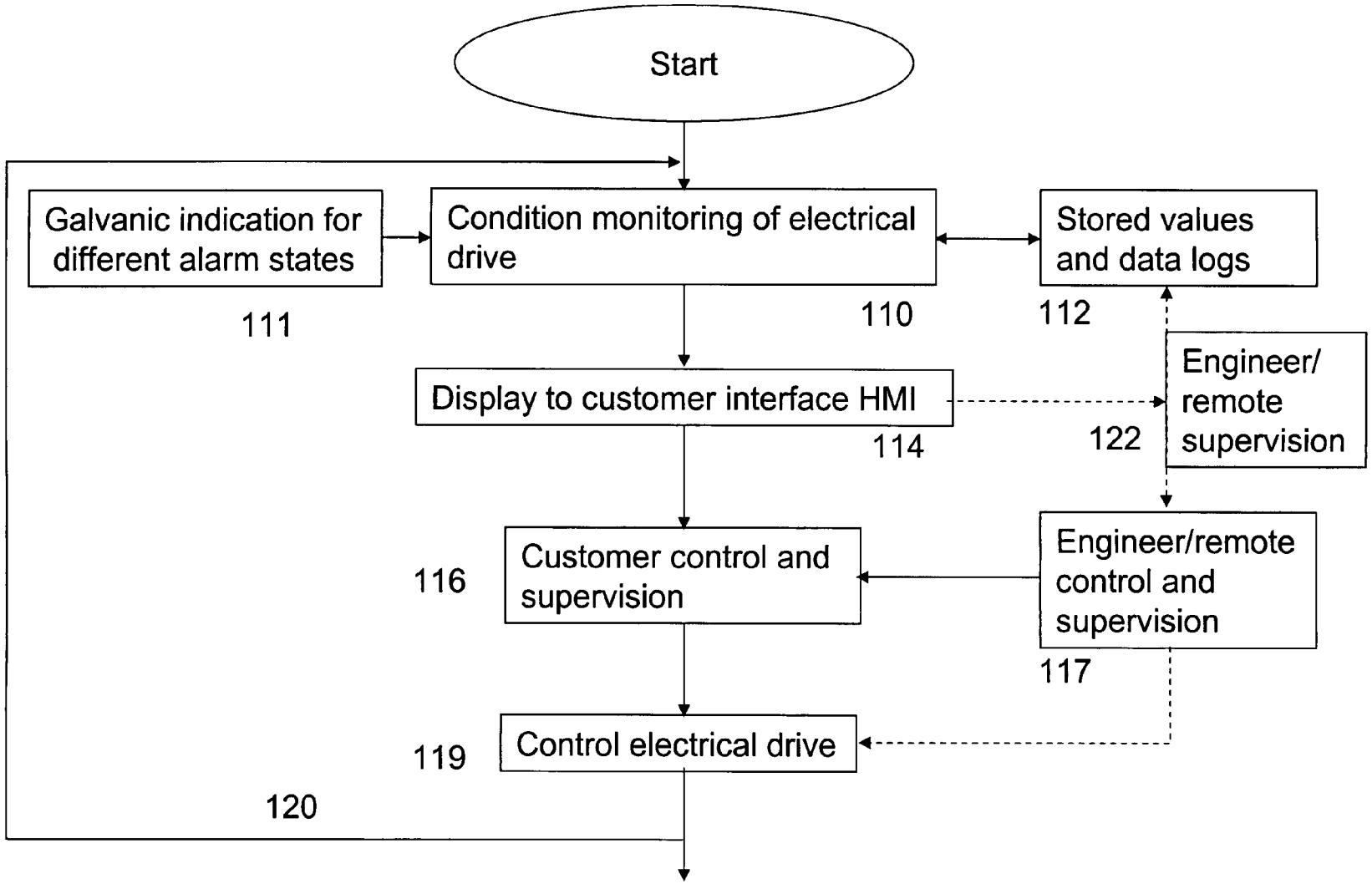
FIG. 7 shows a flow chart for a method according to an embodiment of the present invention.

FIG. 7 shows a simplified flowchart for one or more methods according to another aspect of the invention. The figure shows that information including galvanic indicators for various alarm states 111 are sent by the electrically powered actuator or electric drive to a condition monitor in a control unit. Condition monitoring takes place at 110, receiving data from the electric drive and/or accessing stored values or data logs 112. Monitoring is displayed by the HMI at step 114. Remote monitoring or supervision may be carried out 122. Such remote monitoring may also have access to the stored values and data logs.

The customer may monitor, supervise and or control the switchgear device 116. This may also be carried out in remote mode by the customer or by an engineer 117. The electrical drive may be controlled 119, for example the speed changed and/or a the drive switched on or off and so on. Condition monitoring may be repeated or continued with these steps in the same order 120 or a modified order.

The methods of condition monitoring as described above and elsewhere in this specification may be carried out by a computer application comprising computer program elements or software code which, when loaded in a processor or computer, causes the computer or processor to carry out the method steps. The method may be described as comprising:

receive data from the actuator or electric drive 111, monitor, supervise and or control the switchgear device 116 based at least in part on data 111 from the actuator, monitor and/or control in local or remote mode by the customer or by an engineer 117, control electrical drive 119, local or remote, continue 120 or repeat condition monitoring and/or control steps.

In other embodiments of the invention, the electrically powered actuator of the switchgear device or circuit breaker may be an AC motor. In alternative forms, the electrically powered actuator may be any of a solonoid, a servo motor or a linear motor. The position sensor may optionally sense a position of a drive member along the path of operation of the drive member operating the breaker to open and/or close. The position sensed may then be a position along a linear path, or a rotary path, an arc, or a spiral path.

In another embodiment, one human machine interface 100 and/or the graphic user interface 90 may be used to monitor the condition of a plurality of devices operated by electrically powered actuators, such as circuit breakers.

The functions of the condition monitor may be carried out by processing digital functions, algorithms and/or computer programs and/or by analogue components or analogue circuits or by a combination of both digital and analogue functions. In the best use of the invention, the condition monitor may be comprised as a substantially single circuit. In practice, this may be produced, for example, as an integrated circuit with all the components on one board, an IC or PC circuit board or similar, or as an encapsulated circuit containing all described function blocks, and hence implementing the full functionality of the described invention. The encapsulation may comprise several interconnected silicon-based components, such as programmable hardware, a Central Processing Unit (CPU), and a memory. Alternatively the condition monitor may also be embodied with the majority of the functions comprised on a single chip or wafer.

The methods of the invention may, as previously described, be carried out by means of one or more computer programs comprising computer program code or software portions running on a computer or a processor. The microprocessor (or processors) comprises a central processing unit CPU performing the steps of the method according to one or more facets of the invention. This is performed with the aid of one or more said computer programs, such as, which are stored at least in part in memory 66 and/or 80 and as such accessible by the one or more processors. The or each processor may be in a circuit breaker control unit 60 or condition monitor part thereof, or may as well run in a local or central control system in a local or distributed computerised control system. It is to be understood that said computer programs may also be run on one or more general purpose industrial microprocessors or computers instead of one or more specially adapted computers or processors.

The computer program comprises computer program code elements or software code portions that make the computer perform the method using equations, algorithms, data, stored values and calculations previously described. A part of the program may be stored in a processor as above, but also in a ROM, RAM, PROM, EPROM or EEPROM chip or similar memory means. The program in part or in whole may also be stored on, or in, other suitable computer readable medium such as a magnetic disk, CD-ROM or DVD disk, hard disk, magneto-optical memory storage means, in volatile memory, in flash memory, as firmware, stored on a data server or on one or more arrays of data servers. Other known and suitable media, including removable memory media such as Sony Memory Stick™ and other removable flash memories, hard drives etc. may also be used.

The computer programs described may also be arranged in part as a distributed application capable of running on several different computers or computer systems at more or less the same time. Programs as well as data such as start positions, or flag-related information may be made available for retrieval, delivery or, in the case of programs, execution over the Internet. Data may be accessed by means of any of: OPC, OPC servers, an Object Request Broker such as COM, DCOM or CORBA, a web service. Methods of the invention may also be practised, for example during an installation, or configuration phase, manually during operations, or remotely by means of a Graphical User Interface 90 (GUI), a graphical or textual or mixed display on an operator workstation, running on a user's logged-in computer, which may be connected direct to the breaker control system or a substation control system, or connected via a main or local control server or other control system computer.

The condition monitor according to the invention may be used to monitor and/or control locally and/or monitor and control remotely any of the following switchgear or devices in a transmission or distribution system which comprise an electrically powered actuator: live tank circuit breaker, disconnector, switch-disconnector or load disconnector, earthing switch, disconnector circuit breaker, dead tank circuit breaker, gas-insulated (GIS) circuit breaker, GIS disconnector GIS switch-disconnector GIS earthing switch, switchgear modules including CBs, DCs, SDs etc as above.

It should be noted that while the above describes exemplifying embodiments of the invention, there are several variations and modifications which may be made to the disclosed solution without departing from the scope of the present invention as defined in the appended claims.

In another embodiment, a reserve power supply for the circuit breaker control unit may be provided instead of, or as well as the capacitor 52, by any of: a battery, fuel cell, accumulator wind turbine, solar panel or similar.

In another preferred embodiment the position sensor may be arranged to be driven indirectly by a drive member of the circuit breaker by means of gear, lever, spring or similar, and thus provide position measurements based indirectly on a position of the drive member.

Figure 8:
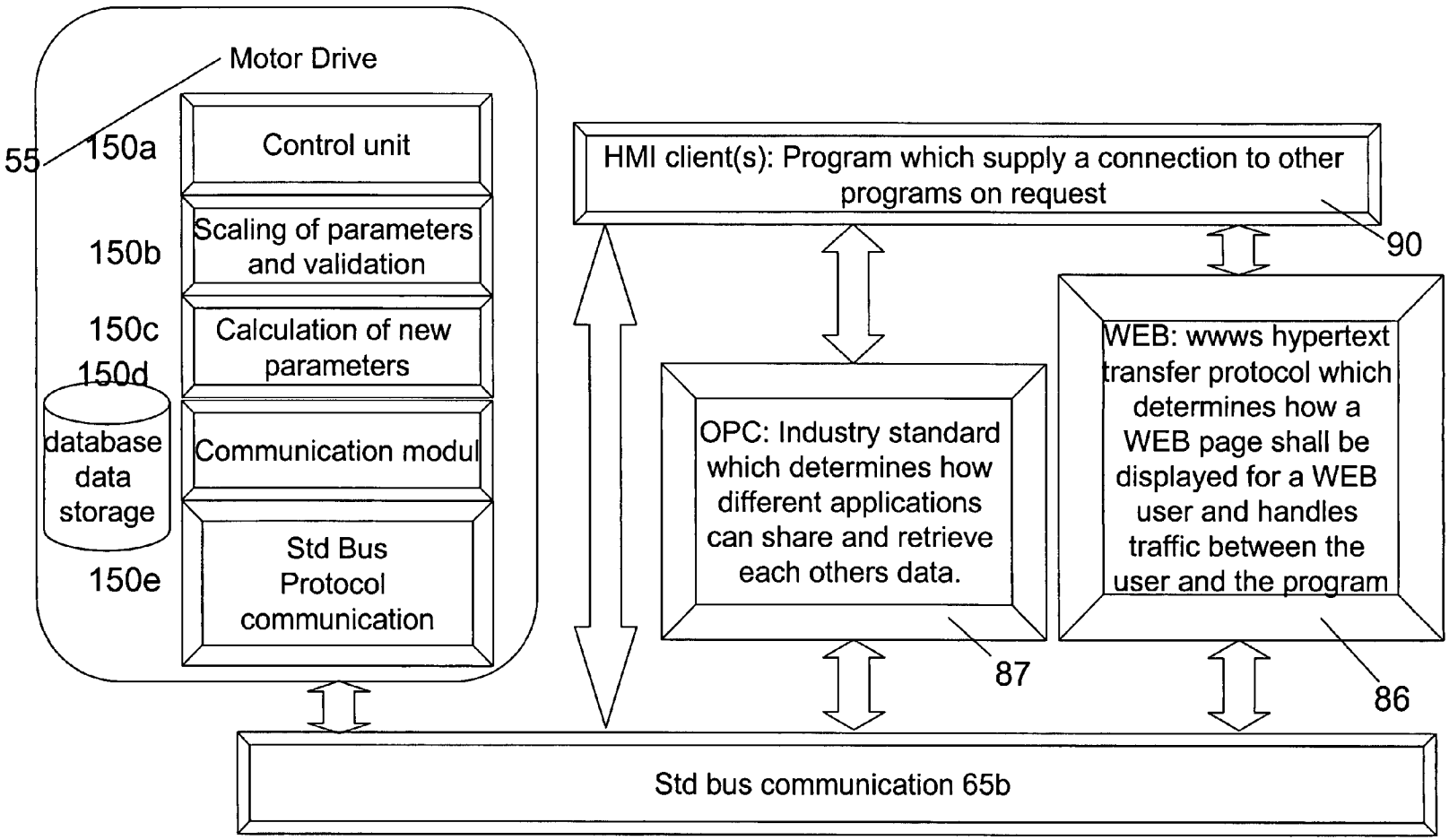
FIG. 8 shows a schematic block diagram for a direct communication for an human machine interface (HMI) and a Control unit according to an embodiment of the invention.

In another preferred embodiment the motor drive (MD) has bus communication protocol interface, such as a standard bus communication protocol interface. This gives the opportunity for the station control or remote control center to directly got information about the operation and monitoring data and these system can view and handling them according the common rules for these system. FIG. 8 shows that the Motor Drive is directly connected to a bus communication 65*b* which can be an optical or electrical wire for example an Ethernet connection. The communication may also be carried out wirelessly by means of a wireless node connected to each of a computer and the control unit, using a wireless system compatible with a WLAN, Bluetooth, WiFi, or similar.

The invention claimed is:

1. A system for monitoring an electrically operated switchgear device, said system comprising:

at least one electrically operated switchgear device for electrical distribution, the switchgear device comprising at least one moving part and an electrically powered actuator configured to actuate the at least one moving part for opening and/or closing the at least one switchgear device, the at least one switchgear device further comprising at least one sensor configured to directly measure operational parameters of the electrically powered actuator;

a control unit configured to receive state information including the sensor measurements of parameters of the electrically powered actuator from the at least one sensor, generate logs of the sensor measurements, the control unit analyzing the sensor measurements and the logs of the sensor measurements to determine a status of the at least one electrically powered actuator and, thereby, operational conditions of the at least one electrically operated switchgear device, and the control unit controlling opening and closing of the at least one switchgear device; and a display configured to present the state information in real time, present display alarms, present the logs, and display an interface configured to permit control of the at least one switchgear device and the control unit.

2. The system according to claim 1, wherein the electrically powered actuator comprises a motor and a drive shaft, and wherein the sensor measurements comprise from any of the list of: motor current, actuator travel or drive shaft travel, micro motion of the drive shaft.

3. The system according to claim 2, wherein the at least one sensor comprises a position sensor configured to sense a position of the electrically powered actuator, the position sensor transmitting the position to the control unit.

4. The system according to claim 3, wherein the position sensor is arranged to sense a position of the electrically powered actuator along a path of movement followed by the electrically powered actuator in opening and closing the switchgear device.

5. The system according to claim 4, wherein the position sensor is arranged to sense a position of the electrically powered actuator along a path of rotation in a plane perpendicular to the drive shaft.

6. The system according to claim 2, wherein the at least one sensor comprises a current sensor configured to measure input current to the electric actuator.

7. The system according to claim 1, wherein electric actuator is an electric motor.

8. The system according to claim 7, wherein the electric motor is a DC motor.

9. The system according to claim 7, wherein the electric motor is a DC motor with variable speed control.

10. The system according to claim 7, wherein the at least one sensor comprises a current sensor.

11. The system according to claim 10, wherein the current sensor comprises an inductive device.

12. The system according to claim 7, wherein the electric motor is a AC motor.

13. The system according to claim 1, wherein the at least one switchgear device is a circuit breaker, and wherein the electrically powered actuator comprises a breaker control unit configured to operate the opening and closing of the circuit breaker.

14. The system according to claim 13, further comprising:

a human machine interface; and means for communication of data between the breaker control unit and the human-machine interface.

15. The system according to claim 14, further comprising:

a device for displaying the human machine interface; and means for direct communication between the control unit and the device for displaying the human-machine interface.

16. Use of a condition monitor according to claim 1 to monitor and control any from the list of: circuit breaker, disconnector, switch-disconnector or load disconnector, earthing switch, switchgear module device with an electrically powered actuator.

17. The system according to claim 1, wherein the control unit and display are remote to the at least one switchgear device.

18. A method for monitoring a condition of a switchgear device, said system comprising at least one electrically operated switchgear device for electrical distribution, the switchgear device comprising at least one moving part and an electrically powered actuator configured to actuate the at least one moving part for opening and/or closing the at least one switchgear device, the at least one switchgear device further comprising at least one sensor configured to directly measure operational parameters of the electrically powered actuator, a control unit configured to receive state information including the sensor measurements of parameters of the electrically powered actuator from the at least one sensor, generate logs of the sensor measurements, the control unit analyzing the sensor measurements and the logs of the sensor measurements to determine a status of the at least one electrically powered actuator and, thereby, operational conditions of the at least one electrically operated switchgear device, and the control unit controlling opening and closing of the at least one switchgear device, and a display configured to present the state information in real time, present display alarms, present the logs, and display an interface configured to permit control of the at least one switchgear device and the control unit, the method comprising:

directly measuring a value of one or more operational parameters for the electrically powered actuator;

storing the value or values in a data storage;

generating a log or logs of the value or values;

calculating a status or condition of the at least one switchgear device based upon the operational parameters and the log or logs of the value or values;

presenting on the display the log or logs, real time state information and the interface; and utilizing the interface to control the at least one switchgear device and the control unit.

19. The method according to claim 18, wherein the electrically powered actuator comprises a motor and a drive shaft, the method further comprising:

sensing a value for any from the list of motor current, actuator travel or drive shaft travel, micro motion of the drive shaft, or storing the value or values; and calculating a status or condition of the switchgear device based on the sensed list of motor current, actuator travel or drive shaft travel, micro motion of the drive shaft, or storing the value or values.

20. The method according to claim 18, further comprising:

sensing a position of the electrically powered actuator;

storing the position value in a data storage; and calculating a status or condition of the switchgear device based upon the sensed position.

21. The method according to claim 18, further comprising:

sensing an input current to the electrically powered actuator.

22. The method according to claim 18, further comprising:

displaying the status or condition of the switchgear device via a human-machine interface embodied as a control panel.

23. The method according to claim 18, further comprising:
displaying the status or condition of the switchgear device on a display means with a human-machine interface comprising a thin client with a graphical user interface.

24. The method according to claim 18, further comprising:
displaying the status or condition of the switchgear device via a human-machine interface embodied as a graphical user interface arranged with executable functions for writing values to a file and/or issuing commands.

25. The method according to claim 24, further comprising:
displaying the status or condition of the switchgear device on a display means with a graphical user interface embodied as thin client running on any from the list of: workstation, portable computer, personal digital assistant, mobile phone, or mobile computing device.

26. The method according to claim 18, further comprising:
displaying the status or condition of the switchgear device for a circuit breaker comprising an electrically powered actuator.

27. The method according to claim 26, further comprising:
communicating the status or condition of the switchgear device on a display means running on a computing device by means of a means for direct communication to the control unit.

28. The method according to claim 18, wherein the log or logs, real time state information and the interface are presented on a display remote to the at least one switchgear device and the interface utilized to control the at least one switchgear device remotely.

29. A computer program product, comprising:
a computer readable medium; and
computer program instructions recorded on the computer readable medium and executable by a processor for carrying out a method for monitoring a condition of a switchgear device, the method comprising directly measuring a value of one or more operational parameters for the electrically powered actuator, storing the value or values in a data storage, generating a log or logs of the value or values, calculating a status or condition of the at least one switchgear device based upon the operational parameters and the log or logs of the value or values, presenting on the display the log or logs, real time state information and the interface, and utilizing the interface to control the at least one switchgear device and the control unit.

30. A human-machine interface for monitoring a condition of a switchgear device in an electrical power distribution system, said switchgear device comprising at least one moving part and an electrically powered actuator configured to actuate the at least one moving part for opening and/or closing the switchgear device, the switchgear device further comprising at least one sensor configured to directly measure operational parameters of the electrically power actuator, and input means to receive state information comprising the operational parameters, means to generate logs of the measured operational parameters, and means to present information, the human-machine interface comprising:
means to receive real time data from said electrically powered actuator;
display elements configured to display the data and the data logs; and
control elements configured to control the switchgear.

31. The human-machine interface according to claim 30, further comprising:
means to receive data dependent on a position of a drive member of the electrically powered actuator.

32. The human-machine interface according to claim 30, further comprising:
means to receive data dependent on input current to the electrically powered actuator.

33. The human-machine interface according to claim 30, further comprising:
means to control power to the electrically powered actuator.

34. The human-machine interface according to claim 30, further comprising:
means to control a speed of the electrically powered actuator.

35. The human-machine interface according to claim 30, further comprising:
selection means to operate the human machine interface in any mode of the following list of modes: local, remote, service.

36. The human-machine interface according to claim 30, further comprising:
selection means to operate the human machine interface in service mode and any mode of local, remote.

37. The human-machine interface according to claim 30, further comprising:
computer application means to operate the human machine interface by means of a thin client or web browser application running on a local or remote computing device.

38. The human-machine interface according to claim 30, further comprising:
computer application means to operate a plurality of human machine interfaces for switchgear devices by means of thin client or web browser applications running on a local or remote computing device.

* * * * *